US007360971B2

(12) United States Patent
Stankus et al.

(10) Patent No.: US 7,360,971 B2
(45) Date of Patent: Apr. 22, 2008

(54) YIELDABLE PROP

(75) Inventors: John C. Stankus, Canonsburg, PA (US); John G. Oldsen, Butler, PA (US); Demrey G. Brandon, Pittsburgh, PA (US)

(73) Assignee: Jennmar Corporation, Pittsburgh, PA (US)

( * ) Notice: Subject to any disclaimer, the term of this patent is extended or adjusted under 35 U.S.C. 154(b) by 0 days.

(21) Appl. No.: 11/053,086

(22) Filed: Feb. 8, 2005

(65) Prior Publication Data

US 2005/0141971 A1 Jun. 30, 2005

Related U.S. Application Data

(62) Division of application No. 10/371,377, filed on Feb. 21, 2003.

(51) Int. Cl.
*E21D 15/14* (2006.01)

(52) U.S. Cl. ..... 405/288; 248/354.4

(58) Field of Classification Search ..... 405/288, 405/290, 294; 248/354.1, 354.3, 354.4, 200.1, 248/125.8; 285/199, 420; 254/102, 93 H, 254/93 R; 24/284, 277; 403/110, 373, 377, 403/109.1

See application file for complete search history.

(56) References Cited

U.S. PATENT DOCUMENTS

| | | | |
|---|---|---|---|
| 844,385 | A | 2/1907 | Mommertz |
| 949,535 | A | 2/1910 | Hamm |
| 1,584,905 | A | 5/1926 | Symons |
| 1,890,423 | A | 12/1932 | Teagarden |
| 2,068,491 | A | 1/1937 | Jakoubek et al. |
| 2,192,079 | A | 2/1940 | Hinselmann et al. |
| 2,670,170 | A | 2/1954 | Haarmann |
| 3,089,742 | A | 5/1963 | Powell |
| 3,690,608 | A | 9/1972 | Poizner |
| 3,839,174 | A | 9/1974 | Srumbos |
| 4,009,855 | A | 3/1977 | Hoffmann et al. |
| 4,449,876 | A | 5/1984 | Glanton |
| 4,983,077 | A | 1/1991 | Sorge et al. |
| 5,015,125 | A | 5/1991 | Seegmiller |
| 5,051,039 | A | 9/1991 | Heiliger |
| 5,583,288 | A | 12/1996 | Brenner et al. |
| 5,720,581 | A | 2/1998 | Bacon et al. |

(Continued)

FOREIGN PATENT DOCUMENTS

EP 0 245 704 A2 11/1987

(Continued)

OTHER PUBLICATIONS

Kolk Maschinenbau GmbH, "PINK—AS®" brochure, undated.

(Continued)

*Primary Examiner*—Sunil Singh
(74) *Attorney, Agent, or Firm*—The Webb Law Firm

(57) ABSTRACT

A yieldable prop having a first end and a second end including a first hollow conduit, a second conduit slidably received in the first hollow conduit, a clamp assembly positioned adjacent to the first hollow conduit and the second conduit, and at least one handle connected to the first hollow conduit and the clamp assembly. The prop further includes a bearing plate positioned at the first end of the yieldable prop, wherein the bearing plate is selected from a shape comprising planar and volcano.

8 Claims, 10 Drawing Sheets

U.S. PATENT DOCUMENTS

| | | | |
|---|---|---|---|
| 5,967,702 | A | 10/1999 | Vogelzang |
| 6,234,541 | B1 | 5/2001 | Wagner et al. |
| 6,409,139 | B1 | 6/2002 | Du Pree |
| 6,481,052 | B1 | 11/2002 | Beall |
| 6,571,426 | B2 | 6/2003 | Chen |

FOREIGN PATENT DOCUMENTS

| | | |
|---|---|---|
| GB | 2209549 | 5/1989 |
| GB | 2260559 | 4/1993 |

OTHER PUBLICATIONS

Shanghai Yonghong Mining Machinery Works, "Solid Hydraulic Pit Prop" brochure, undated.

Heintzmann Corporation, "25-ton Quick Timber, 55-ton Prop" brochure, undated.

Strata Products® (USA) Inc., "ROCPROP™" brochure, 1999.

YIELDABLE PROP

CROSS REFERENCE TO RELATED APPLICATION

This application is a divisional of U.S. patent application Ser. No. 10/371,377, filed Feb. 21, 2003, which claims the benefit of U.S. Provisional Applications bearing Ser. Nos. 60/359,089, filed Feb. 22, 2002; 60/398,290, filed Jul. 24, 2002; and 60/402,281, filed Aug. 9, 2002.

BACKGROUND OF THE INVENTION

1. Field of the Invention

The present invention relates to mine roof props and, more particularly, to a yieldable mine roof prop having two telescoping conduits and a clamp assembly.

2. Brief Description of the Prior Art

A mine roof support system having two yielding props connected to one another by a support cross member is known. The yieldable props in the known mine roof support system each include a clamp assembly which includes a clamp having a first split conduit, a second split conduit, at least one U-shaped bolt, an arch-shaped brace, and internally threaded nuts.

SUMMARY OF THE INVENTION

The present invention generally includes a yieldable prop having a first end and a second end and includes a first hollow conduit, a second conduit slidably received in the first hollow conduit, a clamp assembly positioned adjacent to the first hollow conduit and the second conduit, and at least one handle connected to the first hollow conduit or the second conduit and the clamp assembly. The prop further includes a bearing plate positioned at the first and/or second end of the yieldable prop, wherein the bearing plate defines a planar shape, a volcano shape, a C- or I- cross sectional shape, or some other suitable shape.

The first conduit has a first length, the second conduit has a second length, and the first and second lengths are chosen as a function of seam height and desired overlap of the first and second conduits. The clamp assembly according to one embodiment of the present invention includes a first split conduit defining a first inner surface and a first outer surface, a second split conduit defining a second inner surface and a second outer surface, at least one U-shaped bolt having a U-shaped portion and two threaded legs, and a brace defining first and second leg orifices. Threaded nuts are also included, wherein the internally threaded nuts are individually received on a respective threaded leg and are torqued to approximately 300 foot pounds.

The first split conduit may further include friction members along the first inner surface, wherein the friction members are tack welds. Second and third embodiment assemblies may include a wedge and a wedge housing or one or more compressible sleeves. The prop may contain a visual tension indicator, such as a chain connected to the first hollow conduit or the second hollow conduit, and one of the bearing plates. A jack assembly may be positioned adjacent to the first hollow conduit and the second hollow conduit, the jack assembly including a jack body having a first jack end, a second jack end, a fluid inlet opening, and a piston having a plunger and a piston arm. The plunger is connected to one end of the piston arm and the plunger is housed in the jack body. A second clamp assembly is positioned at the second jack end of the jack body and a base defining a first partial orifice is positioned at the other end of the piston arm, opposite the plunger. A guide defining a second partial orifice is positioned adjacent to the first jack end of the jack body.

An alternate jack assembly may include a stock base, a dowel connected to the stock base, a manual ratchet jack attached to the dowel, and a stock head connected to the manual ratchet jack.

DETAILED DESCRIPTION OF THE INVENTION

Figure 1:
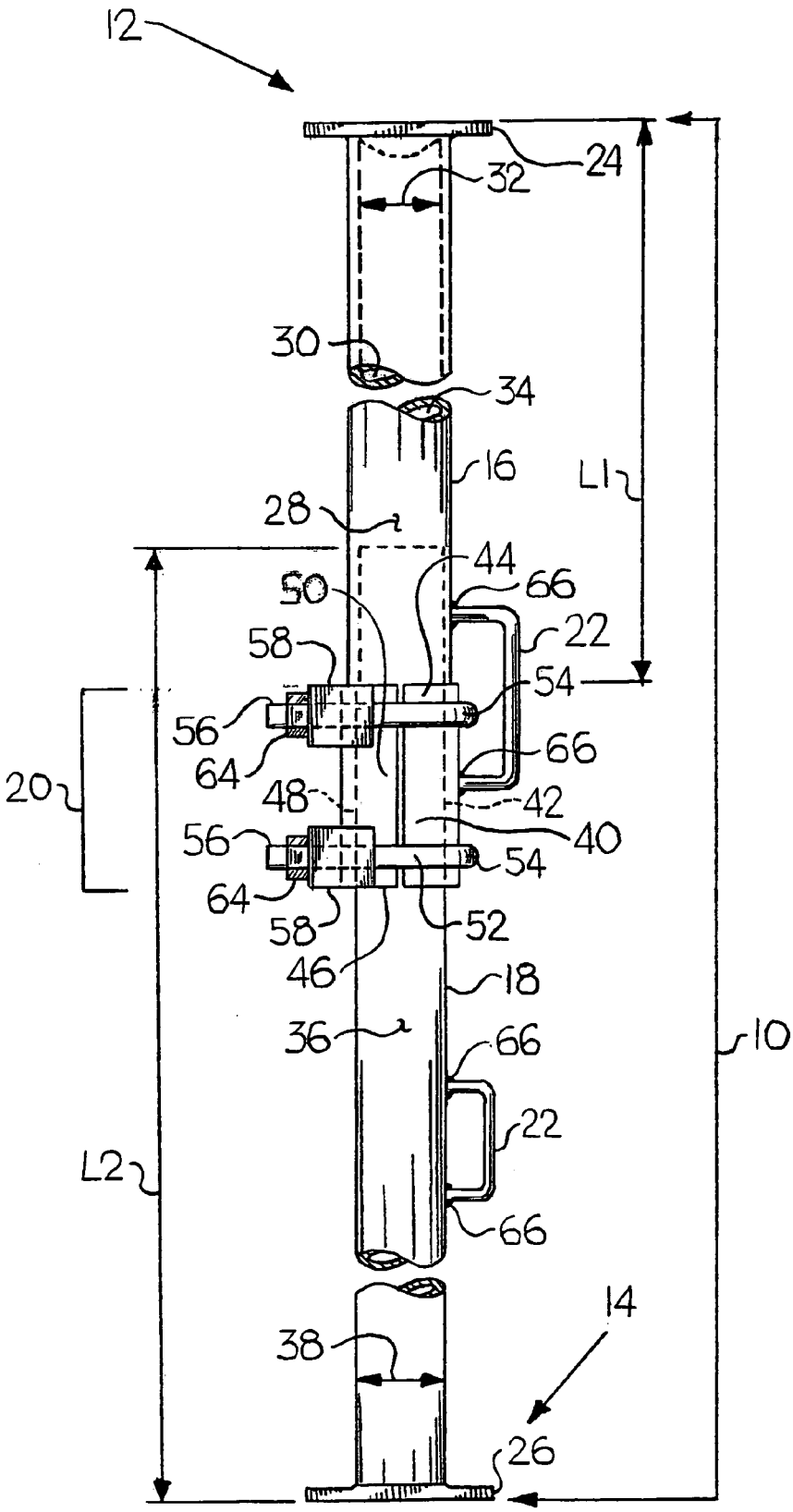
FIG. 1 is a side view of a first embodiment yieldable prop according the present invention.

As shown in FIG. 1, a yieldable prop 10 according to the present invention has a first end 12, a second end 14, a first conduit 16, a second conduit 18, a first clamp assembly 20, at least one handle 22, and optional first and second bearing plates 24, 26. The first conduit 16 is preferably a cylindrical hollow pipe, such as a nominal three and one-half inch schedule 40 pipe, a nominal three inch schedule 40, a nominal three inch schedule 80 pipe, or a two and one-half inch schedule 40 pipe, defining a first outer surface 28 and a first inner surface 30, with the first inner surface 30 further defining a first inner diameter 32, and a first hollow cavity 34. The second conduit 18 is preferably also a cylindrical hollow or solid pipe having a second outer surface 36 which defines a second outer diameter 38. Both the first and second conduits 16, 18 are each preferably made from metal, such as steel, having a wall thickness of approximately ⅛ to ¾ inch. A handle 22 is preferably attached to the first clamp assembly 20 and the first conduit 16 to help prevent the clamp assembly 20 and the prop 10 from becoming disassembled during shipping or handling.

The second conduit 18 is slidably positioned in the first hollow cavity 34 defined by the first conduit 16 in a telescoping relationship. Therefore, the second outer diameter 38 of the second conduit 18 is less than the first inner diameter 32 of the first conduit 16.

Although cylindrically-shaped conduits (pipes) are preferred, alternatively-shaped conduits are also contemplated. Moreover, for reasons discussed below, it has been discovered that a first length L1 and a second length L2 should be selected as a function of seam height to obtain maximum benefits and allow for maximum overlap of the first conduit 16 and second conduit 18 when the conduits are fully nested together.

Figure 2:
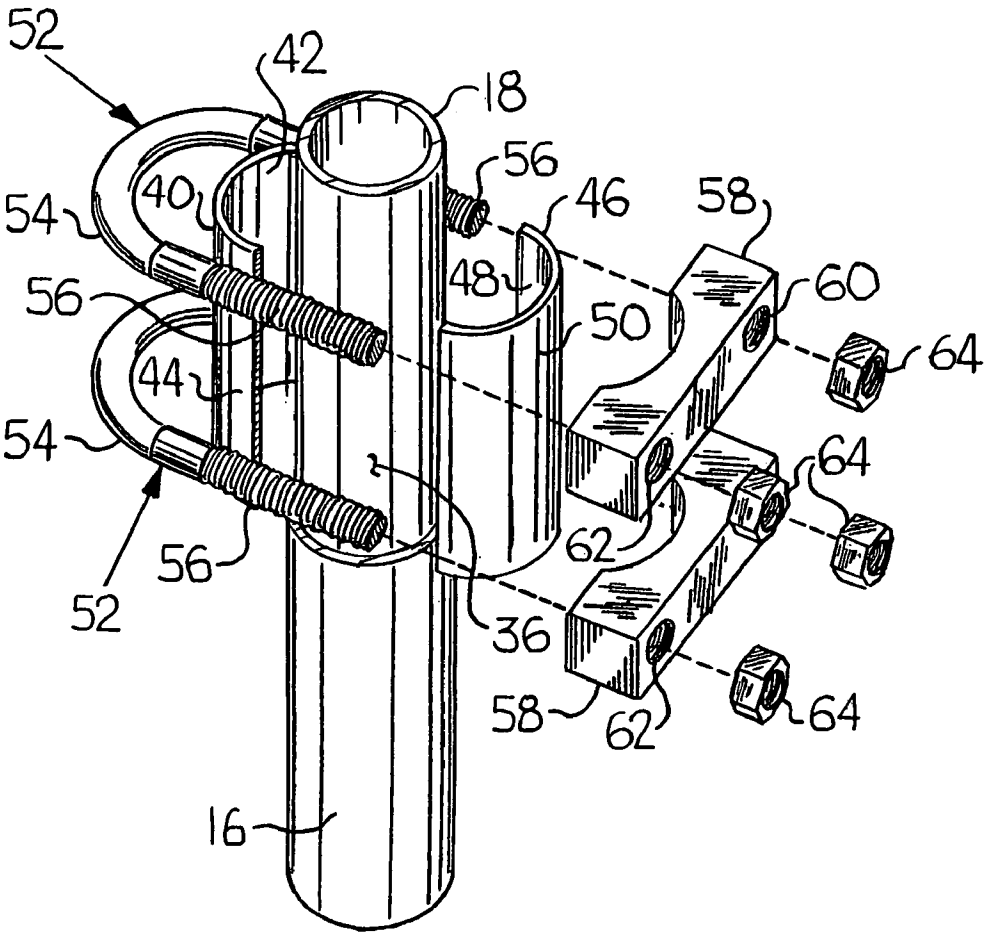
FIG. 2 is an exploded top perspective view of a first clamp assembly according to the present invention.

The first clamp assembly 20 is positioned adjacent to the second outer surface 36 of the second conduit 18. As shown in FIGS. 1 and 2, the first clamp assembly 20 preferably includes a first split conduit 40 defining a first split inner surface 42 and a first split outer surface 44, a second split conduit 46 defining a second split inner surface 48 and a second split outer surface 50, and at least one bolt 52 having an outer surface compatible with an outer shape of the conduit used. Because cylindrically-shaped conduits are shown, the bolt 52 has a U-shaped portion 54 and two threaded legs 56. A brace having an outer surface compatible with an outer shape of the conduit used, such as an arch-shaped brace 58, defines first and second leg orifices 60, 62 (FIG. 2 only). Two internally threaded nuts 64 individually engage each threaded leg 56, and hardened or frictionless washers (not shown) may also be used in conjunction with the threaded nuts 64. The frictionless washers aid in torquing the threaded nuts 64. The first split conduit 40 and the second split conduit 46 are each preferably made from metal, such as steel, having a thickness of approximately ⅛ to ¾ inch. The U-shaped bolt or bolts 52, the arch-shaped brace 58, and the internally threaded nuts 64 are also preferably made from metal or other suitable material.

Figure 3:
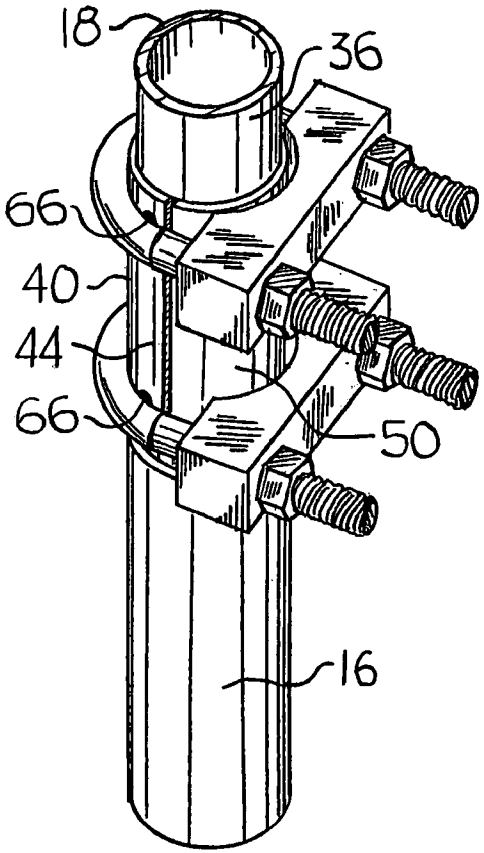
FIG. 3 is a perspective view of the first clamp assembly shown in FIG. 2.

As shown generally in the combination of FIGS. 2 and 3, the first split inner surface 42 of the first split conduit 40 and the second split inner surface 48 of the second split conduit 46 are each respectively positioned partially around the second outer surface 36 of the second conduit 18. The U-shaped portion 54 of the U-shaped bolt or bolts 52 is positioned adjacent to the first split outer surface 44 of the first split conduit 40. Each threaded leg 56 of each U-shaped bolt 52 extends through the respective first or second leg orifices 60, 62 defined by the arch-shaped brace 58. When the threaded nuts 64 are tightened in the conventional manner, such as by clockwise rotation, the U-shaped portion 54 of the U-shaped bolt 52 exerts a force on the first split conduit 40, while the arch-shaped brace 58 exerts a force on the second split conduit 46. In turn, the first and second split conduits 40, 46 each exert a force on the second outer surface 36 defined by the second conduit 18.

Because the first clamp assembly 20 is a combination of pieces, the first clamp assembly 20 can be vibrated loose during shipping. To solve this problem, as shown in FIG. 3, the U-shaped portion 54 of the U-shaped bolt or bolts 52 is tack welded 66 or otherwise attached to the first split conduit 40. As shown in FIG. 1, and as discussed above, a handle 22 may also be tack welded 66 or otherwise connected to both the first conduit 16 and the clamp assembly 20.

Referring to FIG. 1, the first and second bearing plates 24, 26 may be flat plates (26) welded to opposing ends of the yieldable prop 10 or non-attached, self-seating dome or volcano-type plates (24), which adjust for an uneven mine roof or mine tunnel floor or any combination herein described. Other types of bearing devices may also be used. For example, a C-shaped channel can be used to abut a roof beam. The readily detachable dome or volcano-type plates are advantageous because they allow the prop 10 to be easily dragged or otherwise handled within the cramped confines of a mine tunnel. Weight of the prop 10 is also reduced.

Figure 4:
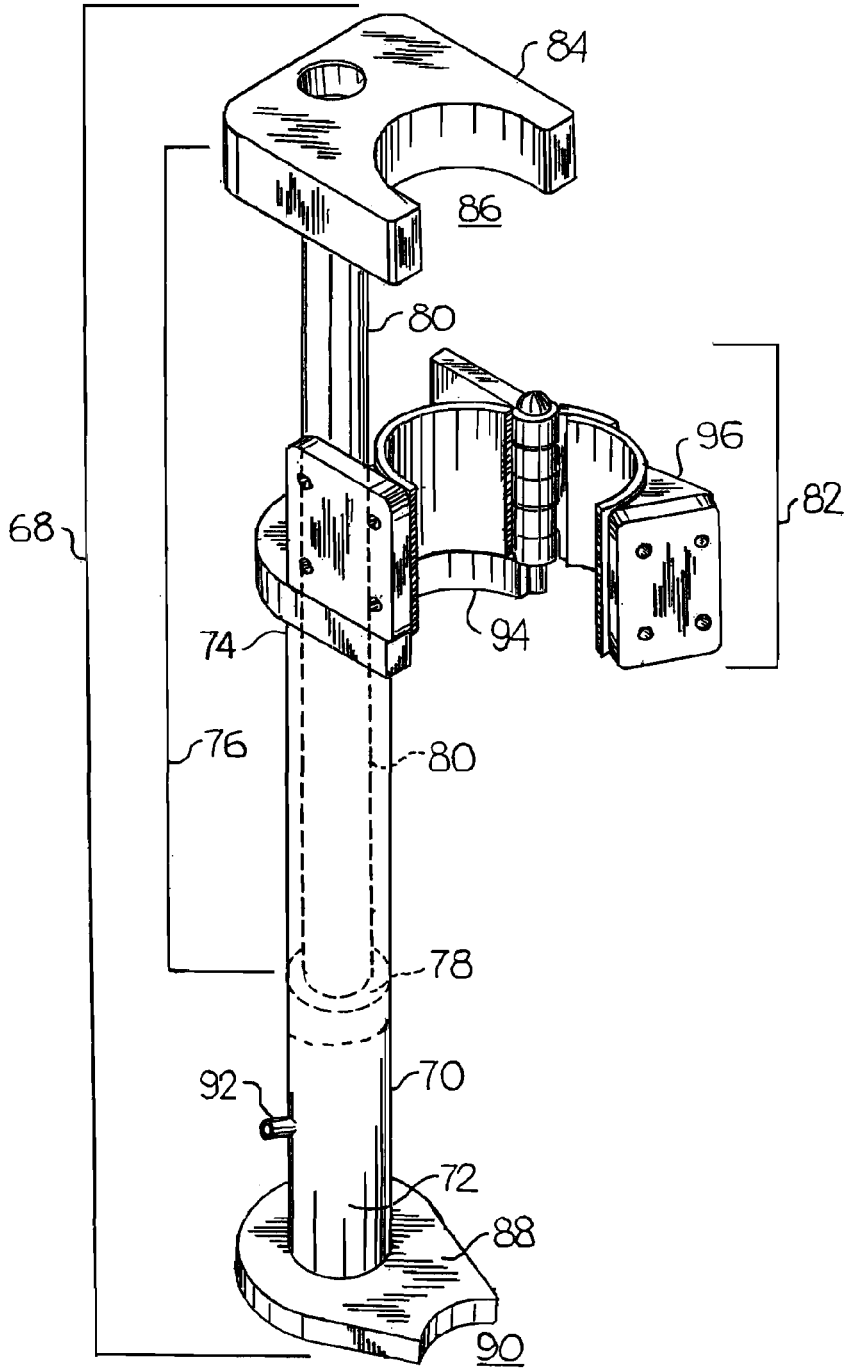
FIG. 4 is a top perspective view of a first embodiment jack assembly.

Because the yieldable prop 10 is adjustable in overall height due to the telescoping arrangement of the first conduit 16 and the second conduit 18, a jack assembly 68 is used to adjust the overall height or length of the yieldable prop 10. One suitable jack assembly 68 is shown in FIG. 4. The jack assembly 68 generally includes a jack body 70 having a first jack end 72 and a second jack end 74, a piston 76 having a plunger 78 and a piston arm 80, a jack clamp 82, a base 84 defining a first partial orifice 86, and a guide 88 defining a second partial orifice 90. The jack body 70 has a fluid inlet opening 92 and further houses the plunger 78 of the piston 76. The piston arm 80 is partially housed in the jack body 70 and partially extends away from the second jack end 74 of the jack body 70. The guide 88 is positioned adjacent to the first jack end 72 of the jack body 70. The base 84 is positioned at the other end of the piston arm 80, opposite the plunger 78. The second clamp assembly 82 is positioned on the piston arm 80 adjacent to the second jack end 74 of the jack body 70.

In the preferred embodiment, the piston 76 is pneumatically or hydraulically driven. When a force is exerted on one side of the plunger 78, the piston arm 80 extends away from the jack body 70. When the force is removed or if force is applied to the other side of the plunger 78, the piston arm 80 retracts into the jack body 70.

Figure 5:
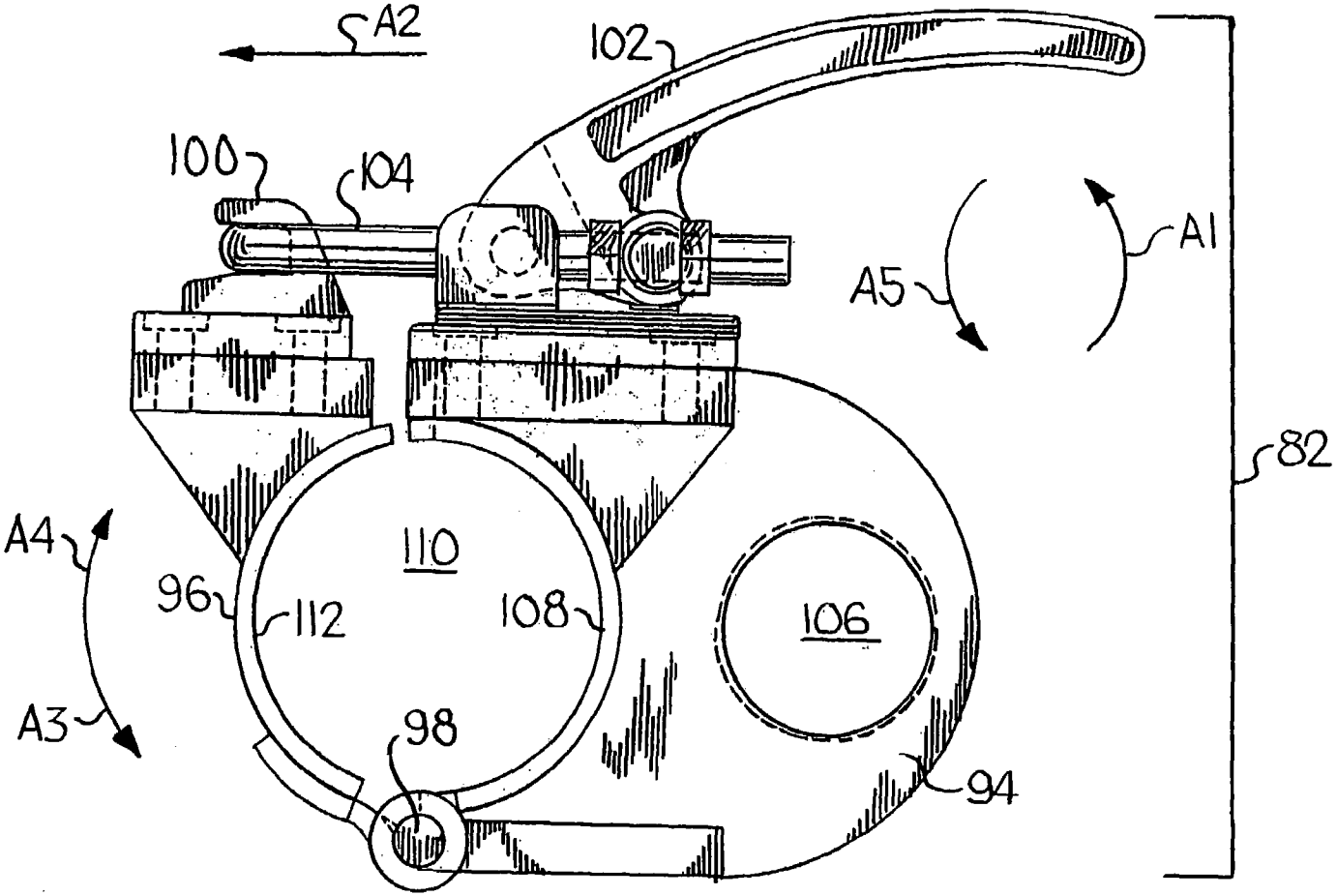
FIG. 5 is a top view of a jack clamp shown in FIG. 4.

FIG. 5 shows the jack clamp 82 in greater detail. The jack clamp 82 may include a clamp plate 94, a pivot arm 96, a pivot pin 98, a hook 100, a second handle 102, and a latch bar 104. The clamp plate 94 defines a clamp orifice 106 which, referring also to FIG. 4, receives the second jack end 74 of the jack body 70 and permits the piston arm 80 to pass through the clamp plate 94. The clamp plate 94 further defines one section 108 of a partial second conduit orifice 110. The pivot arm 96, pivotally connected to the clamp plate 94 via the pivot pin 98, defines another section 112 of the partial second conduit orifice 110. The hook 100 is attached to the pivot arm 96, the second handle 102 is pivotally attached to the clamp plate 94, and the latch bar 104 is connected to the second handle 102.

When the second handle 102 is moved in a first direction, indicated by arrow A1, the latch bar 104 moves in a second direction, indicated by arrow A2, which allows the latch bar 104 to clear the hook 100. This allows the pivot arm 96 to pivot in the third or fourth directions, as indicated by arrows A3 and A4, about pivot pin 98. When the pivot arm 96 is moved in the fourth direction A4, the latch bar 104 can be positioned in engagement with the hook 100, and the second handle 102 may be moved in a fifth direction, indicated by arrow A5, thus releasably clamping the second clamp assembly 82 around the second conduit 18.

Figure 6:
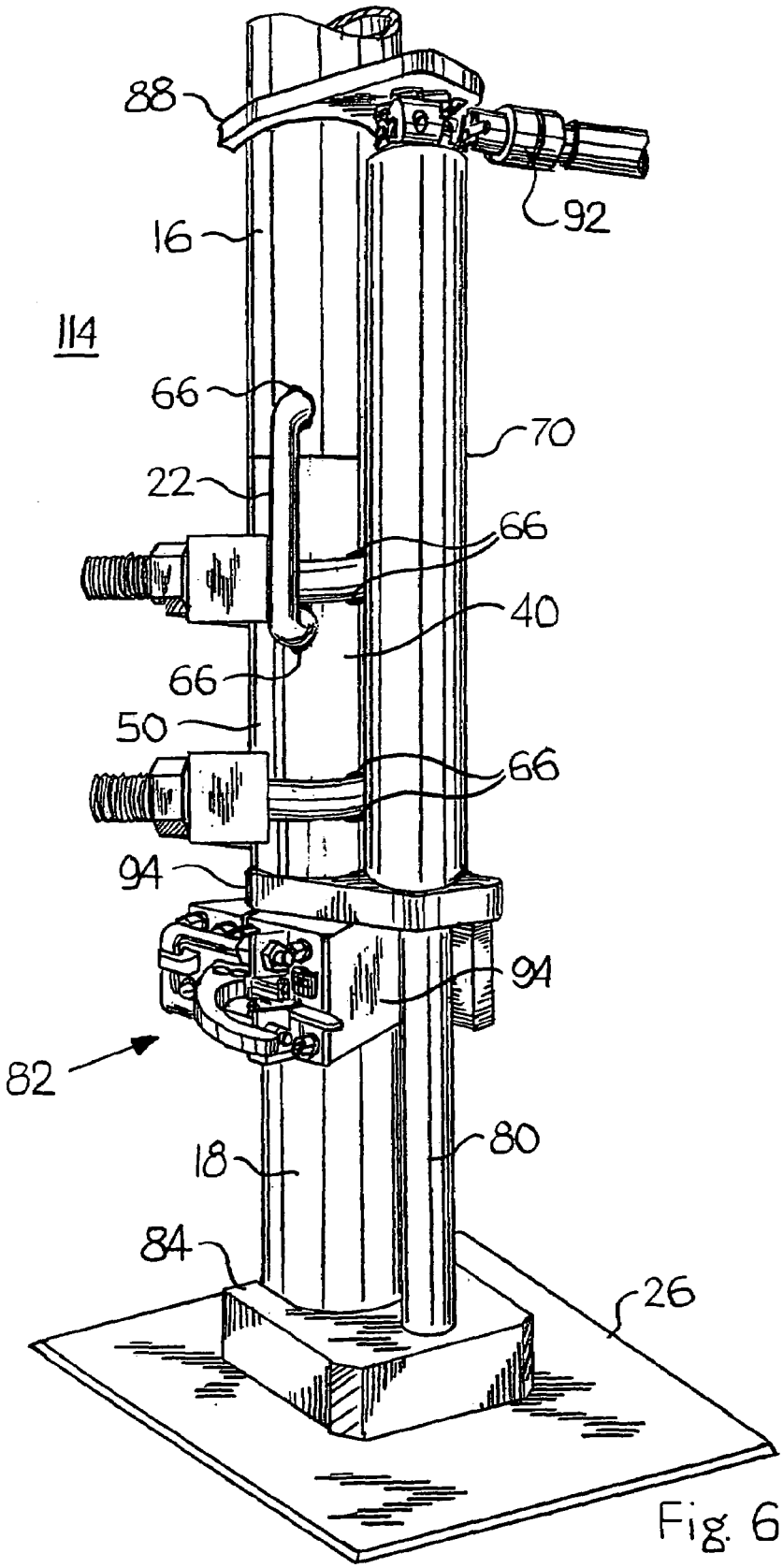
FIG. 6 is a perspective side view of the first embodiment yieldable prop shown in FIG. 1 with the first embodiment jack assembly shown in FIG. 4 removably attached thereto.

One method of installing the yieldable prop 10 will now be discussed. In an installation mode, as shown in FIG. 6, the yieldable prop 10 is positioned horizontally on a support surface 114, such as a mine tunnel floor. The jack assembly 68 is then removably connected to the yieldable prop 10 via the jack clamp 82. The guide 88 partially encompasses the first conduit 16. The base 84 is positioned adjacent to the second bearing plate 26.

Figure 7:
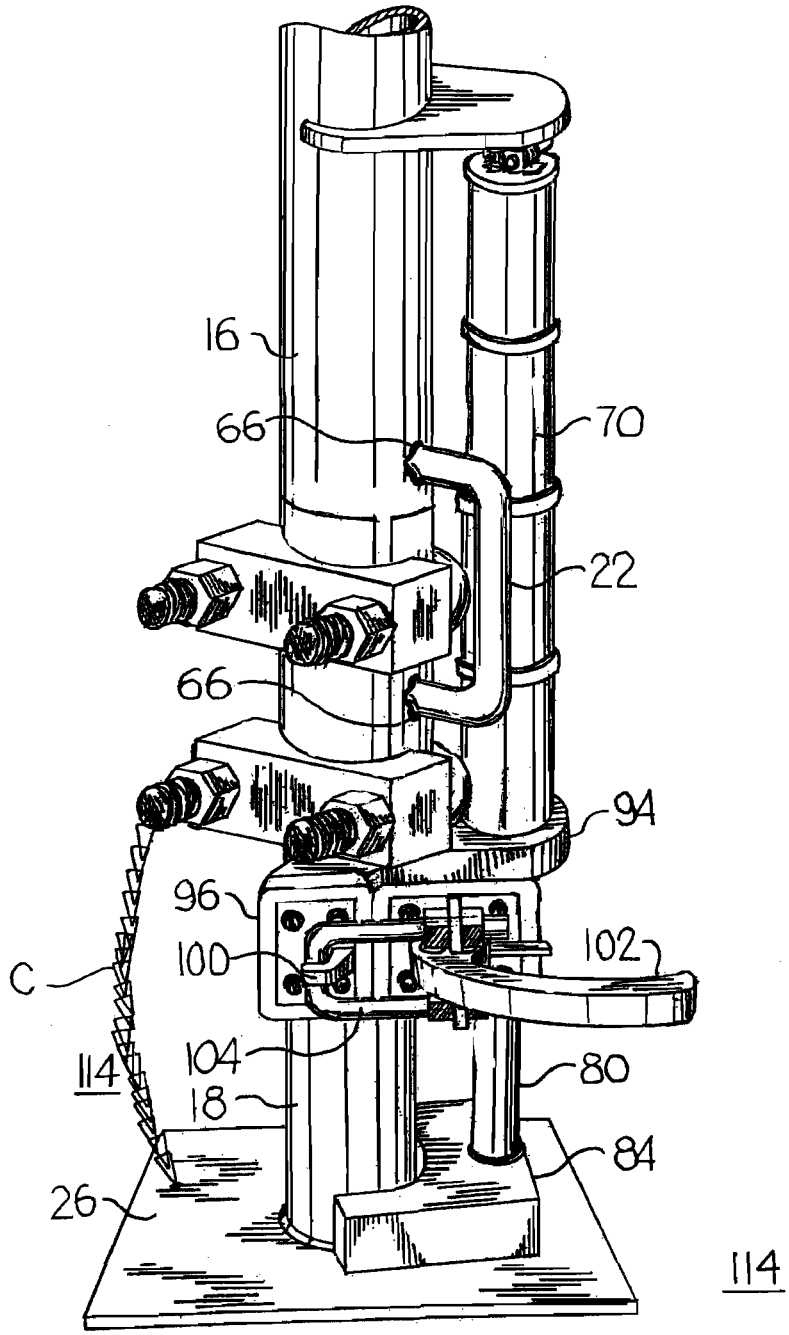
FIG. 7 is a side perspective view of the first embodiment yieldable prop and first embodiment jack assembly shown in FIG. 6.

As shown in FIG. 7, the yieldable prop 10 is then lifted into a perpendicular orientation with respect to the support surface 114. It is noted that the installation position of the yieldable prop 10 may be reversed, such that the first bearing plate 24 is positioned adjacent to the support surface 114.

In the orientation shown in FIG. 7, the second bearing plate 26 may be positioned adjacent to the support surface 114. Pressurized fluid, such as pneumatic or hydraulic fluid, is then allowed to enter the jack body 70. The pressurized fluid forces the piston arm 80 away from the jack body 70 and telescopes the first conduit 16 along the second conduit 18. A chain C having a predetermined length may be attached to the first conduit 16 and to the bearing plate 26 to indicate a desired extension length. It should be readily apparent to one skilled in the art that if the force acting on the plunger 78 (FIG. 4) is greater than the force required to crush or fragment the material which constitutes the mine roof or the mine floor, then the bearing plates 24, 26 will begin to be driven into the mine roof and the mine floor. To combat this effect, bearing plates having larger surface areas may be used. Also, to help combat non-symmetric loading, a dome-shaped bearing plate may also be used as discussed above.

Figure 8:
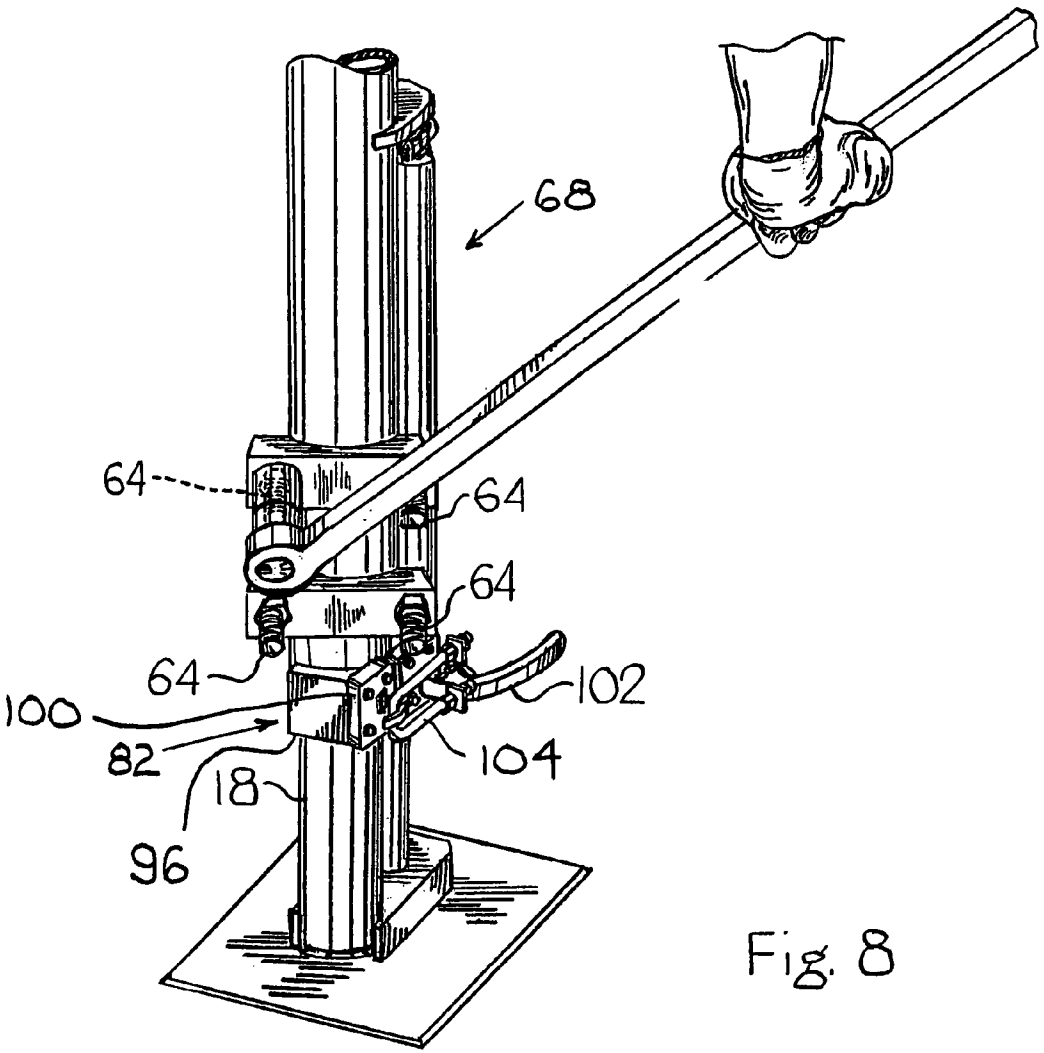
FIG. 8 is a side perspective view of the first embodiment yieldable prop and first embodiment jack assembly shown in FIG. 7.

As shown in FIG. 8, once the yieldable prop 10 has been telescoped to its desired length, the threaded nuts 64 are then torqued to approximately 300 foot pounds. The torquing of the threaded nuts 64 clamps the first and second split conduits 40, 46 (FIGS. 3 and 4) around the second conduit 18 and temporarily prevents the second conduit 18 from telescoping back inside the first conduit 16. At this point, the jack assembly 68 can be removed by moving the second handle 102 of the jack clamp 82 in the manner previously discussed above, such that the latch bar 104 can clear the hook 100 and the pivot arm 96 can be pivoted away from the clamp plate 94 (FIG. 5). Once tensioned, the yieldable prop 10 will retain its original tension until a compression or loading force acts on the yieldable prop 10.

Figure 9:
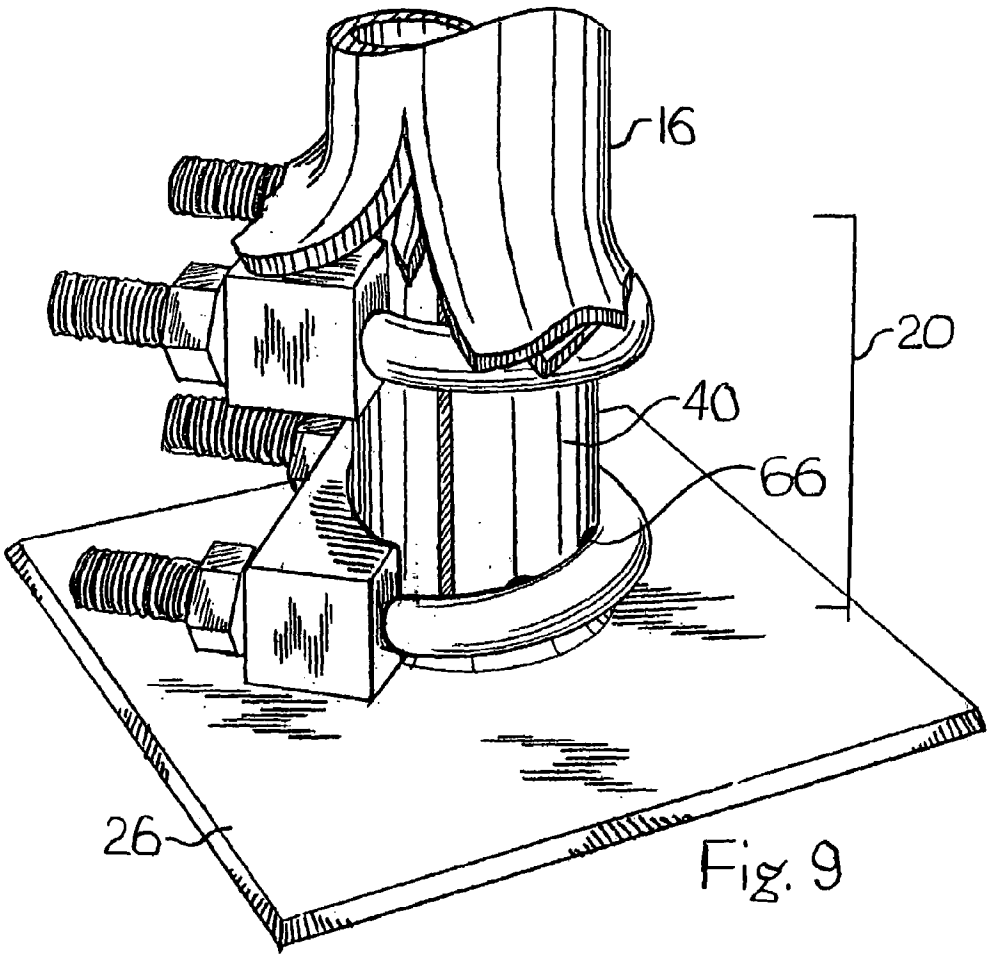
FIG. 9 is a side perspective view of one end of the first embodiment yieldable prop shown in FIG. 1, wherein the two conduits are telescoped together.

As shown in FIG. 9, as a compression load acts to compress the yieldable prop 10, such as a shifting mine tunnel roof, the clamp assembly 20 will slip and the second conduit 18 will gradually telescope back into the first conduit 16. Further compression of the yieldable prop 10 may drive the first conduit 16 into the first clamp assembly 20. At this point, further loading may begin to buckle the first and second conduits 16, 18 or split the first conduit 16. The buckling of the first and second conduits 16, 18 can be postponed by making the first conduit 16 and the second conduit 18 substantially overlap one another. During testing, it was observed that buckling may occur at a point along the first conduit 16 where there was not an overlap of the first conduit 16 and the second conduit 18. Also, increasing wall thickness of the first and second conduits 16, 18 may help to retard buckling of the yieldable prop 10.

Figure 10:
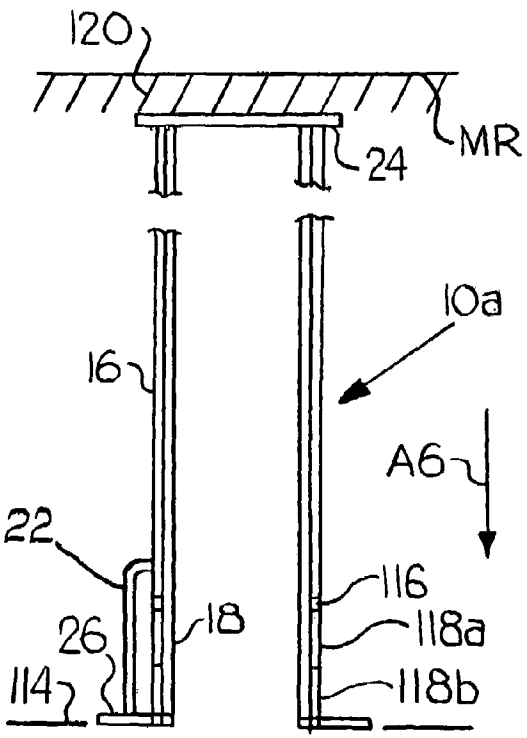
FIG. 10 is partial cross-sectional view of a second embodiment yieldable prop and a second embodiment clamp assembly according to the present invention.

A second embodiment yieldable prop 10*a* is generally shown in FIG. 10. The second embodiment is similar to the first embodiment, with like reference numerals indicating like parts and the previous discussion regarding bearing plates herein incorporated in its entirety. However, one difference between the first embodiment yieldable prop 10 and the second embodiment yieldable prop 10*a* is that the first clamp assembly 20 is removed and replaced with a generally cylindrically-shaped collar 116 and one or more collapsible inserts 118*a*, 118*b* positioned between the first conduit 16 and the second bearing plate 26 or, conversely, between the second conduit 18 and first bearing plate 24 if the prop 10*a* is reversed. The collar 116 may have the same outer diameter as the inserts 118*a*, 118*b* or have an outer diameter which is greater than the outer diameter of the inserts 118*a*, 118*b*.

The second embodiment yieldable prop 10*a* is designed to be adjustable in the A6 direction, as shown in FIG. 10. The yieldable prop 10*a* is preferably made at a predetermined overall length which is dependent upon the distance between a mine roof and a mine floor. For the purpose of example only, a six foot high mine passageway may require a five foot, eight inch prop 10*a*. To help keep the various pieces together during shipping, a handle 22 may be added to the first conduit 16 and a bearing plate 26. As noted above with respect to the first embodiment yieldable prop 10, the bearing plates 24, 26 may be removable so that the handle 22 may also be connected to the insert 118*b*.

Installation of the second embodiment yieldable prop 10*a* is straightforward. The prop 10*a* is erected to so that the first and second conduits 16, 18 are substantially perpendicular to a mine roof MR and support surface 114 or any other two opposed surfaces. Because the prop 10*a* is made slightly shorter than the distance between the mine roof MR and support surface 114, compressible material 120, such as wood or other suitable material, is forced between the first bearing plate 24 or 26 and the mine roof MR so that the prop 10*a* is wedged snuggly between the mine roof MR and the support surface 114.

If the mine roof MR shifts and applies a compression load in the A6 direction, the force of the compression load is generally transferred to the compressible material 120, the bearing plates 24, 26, the first conduit 16, the second conduit 18, and the collar 116. In turn, the collar 116 exerts a force against the insert or inserts 118*a*, 118*b*.

The collar 116 is preferably made from a durable material, such as steel. The insert or inserts 118*a*, 118*b* are preferably each made from one gauge of steel having a predetermined yield value or different gauges of steel each having individual predetermined yield values. Therefore, the inserts 118*a*, 118*b* will resist compression until the compression load exceeds the structural endurance of the insert 118*a*, 118*b*. As shown in FIG. 10, inserts 118*a*, 118*b* can be made from the same gauge steel and will therefore yield in a similar manner. Inserts 118*a*, 118*b* may also be integrally formed. If staged yielding is desired, insert 118*a* can be made from a thinner gauge material than insert 118*b*. In this configuration, insert 118*a* will compress before insert 118*b*. In compression tests, inserts made from A513 tubing and having a thickness of approximately 0.120 inch yielded when subjected to a compression force of approximately fifty tons. It has been found that the inserts 118*a*, 118*b* tend to compress rather than split, and generally each define an accordion-shaped, cross-sectional profile after being compressed. The accordion-like compression of the inserts 118*a*, 118*b* results in a cyclical resistance yield pattern. The cyclical pattern is believed to be the result of the insert contacting the conduit, the insert yielding, and insert contacting the conduit again, and process repeating.

Figure 11:
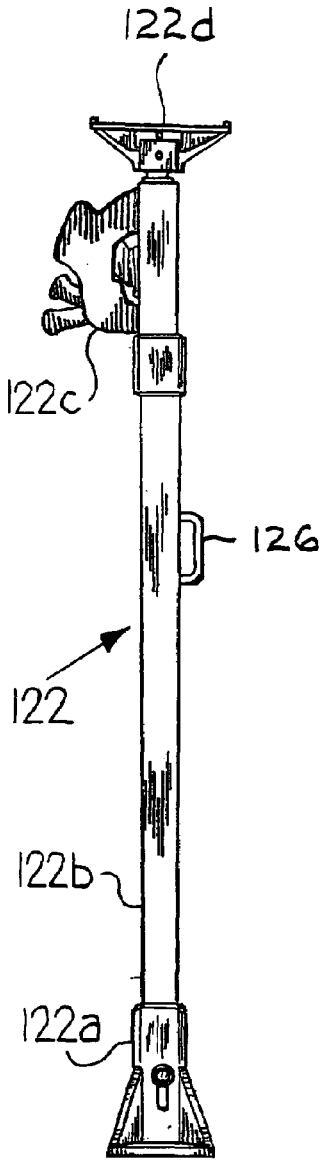
FIG. 11 is a side view of a commercially available jack assembly.
Figure 12:
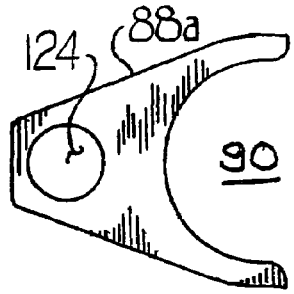
FIG. 12 is a plan view of a second embodiment guide.
Figure 13:
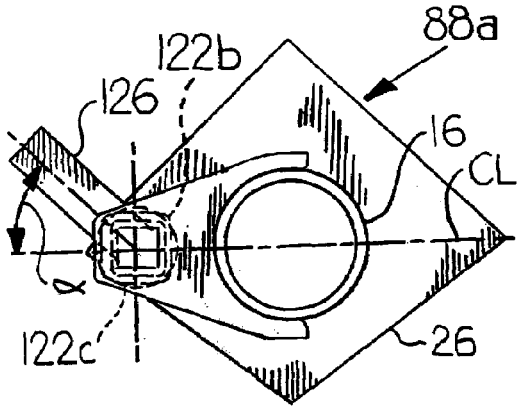
FIG. 13 is a partial top view of the second embodiment jack assembly shown in FIG. 11 fitted with the second embodiment guide shown in FIG. 12 and an offset handle.
Figure 14:
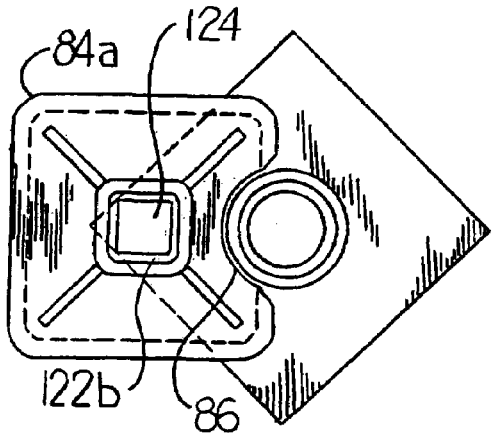
FIG. 14 is a partial top view of a second embodiment base.

A commercially available jack assembly 122 is shown in FIG. 11 and is modified in FIGS. 12-14. The jack assembly 122 is preferably a manual jack-type support, such as the Model A9225 commercially available from SIMPLEX, Broadview, Ill. and herein incorporated by reference in its entirety. The jack assembly 122 generally includes a stock base 122*a*, a dowel 122*b* connected to the stock base 122*a*, a manual ratchet jack 122*c* attached to the dowel 122*b*, and a stock head 122*d* connected to the manual ratchet jack 122*c*. The jack assembly 122 is used primarily with the first embodiment yieldable prop 10, subject to the modifications shown generally in FIGS. 12-14.

FIG. 12 shows a second guide 88*a* defining a post receiving orifice 124 and a second partial orifice 90. As shown in FIG. 13, the second guide 88*a* replaces the stock head 122*d* which is included with the Model A9225 support, with the partial orifice 90 receiving the first conduit 16. A handle 126 is also offset at an angle α with respect to centerline CL, instead of being substantially aligned with centerline CL. Similarly, as shown in FIG. 14, the second embodiment base 84*a* also defines a post receiving orifice 124 and a first partial orifice 86.

The second embodiment jack assembly, which is herein defined as the combination of the modified jack assembly 122, the second guide 88*a*, and the second embodiment base 84*a*, is raised and lowered by the manual ratchet jack 122*c*. The operation of the second embodiment jack assembly is used for substantially the same purpose as the first embodiment jack assembly discussed above, namely, the expanding of the prop 10. A hook and latch strap may be used to temporarily secure the second embodiment jack assembly to the prop 10.

Figure 15:
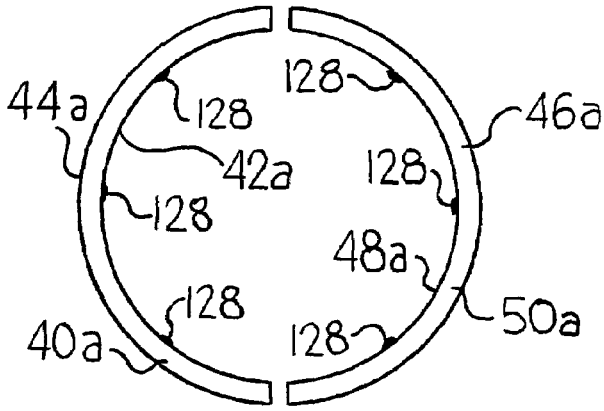
FIG. 15 is a plan view of a third embodiment clamp assembly.

As shown in FIG. 15, a first split conduit 40*a* defining a first split inner surface 42*a* and a first split outer surface 44*a* and a second split 46*a* conduit defining a second split inner surface 48*a* and a second split outer surface 50*a* can also be used with the first and second split inner surfaces 42*a*, 48*a* having friction members 128, such as tack welds, attached thereto. In this latter embodiment, it has been found that only one U-shaped bolt (discussed above) is required and the friction members 128 gouge into the first conduit 16 to help resist compression.

Figure 16:
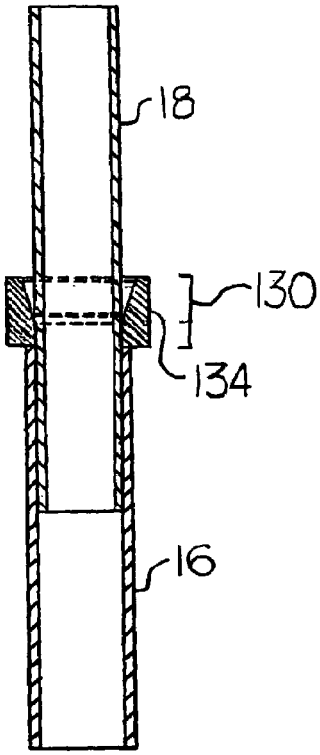
FIG. 16 is cross-sectional side view of a third embodiment yieldable prop according to the present invention.
Figure 16A:
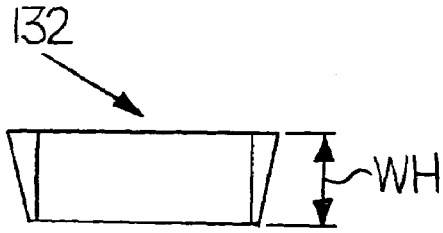
FIG. 16*a* is a cross-sectional side view of a wedge shown in FIG. 16.
Figure 16B:
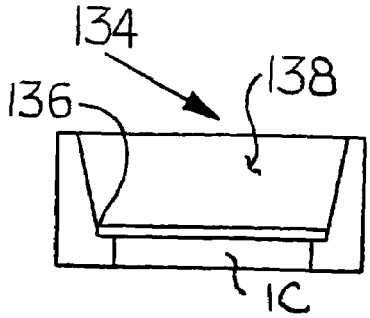
FIG. 16*b* is a cross-sectional side view of a housing shown in FIG. 16.

As shown in FIGS. 16, 16*a*, and 16*b*, a wedge and housing combination 130 can also be used to provide predetermined loading. As shown in greater detail in FIG. 16*a*, the wedge 132 is preferably a hollow cylindrical member having a height WH of approximately 1 inch, a tapered outer diameter starting at approximately 3.6 inches, and tapering to a base level outside diameter of approximately 2.9 inches. The wedge 132 is attached to the external surface of the second conduit 18 by friction, clamping, welding, or other suitable method. The housing 134, shown in detail in FIG. 16*b*, has a substantially static outer diameter, but includes an inner diameter that tapers from approximately 4.2 inches to an intermediate internal diameter of approximately 3.4 inches. A lip 136 is defined at the base level inner diameter of the housing 134, wherein the lip 136 and tapered inner diameter of the housing 134 define a race 138 that receives the wedge 132. Adjacent to the race 138, the housing 134 defines an internal cavity, approximately one-half inch or more in depth, that receives second conduit 18. The housing 134 is positioned immediately adjacent to one end of the first conduit 16, and prevents the second conduit from entering the housing 134.

Referring again to FIG. 16, when the wedge 132 and housing 134 are employed, the housing 134 exerts a force on the wedge 132 and retards movement of the first conduit 16 with respect to the second conduit 18.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention which is to be given the full breadth of the appended claims and any and all equivalents thereof.

We claim:

1. A yieldable prop comprising:

a first hollow conduit having a first end and an opposite second end;

a second conduit having a first end and an opposite second end;

a clamp assembly positioned on outer surface of the second conduit, the clamp assembly comprising a first side and an opposite second side, with the first side of the clamp assembly facing and spaced from the first end of the second conduit, and the second side of the clamp assembly facing and spaced from the second end of the second conduit, wherein the portion of the second conduit between the first end of the second conduit and the first side of the clamp assembly is slidably mounted in the first conduit through the second end of the first conduit;

a bearing plate mounted on the second end of the second conduit; and a jack assembly comprising a base mounted on the bearing plate of the second conduit and a moveable clamp plate mounted on the base of the jack assembly and in engagement with the second side of the clamp assembly to move the first side of the clamp assembly against the second end of the first conduit to at least move a predetermined length of the portion of the second conduit between the first side of the clamp assembly and the first end of the second conduit out of the first conduit.

2. The prop as claimed in claim 1, further comprising a visual tension indicator.

3. The prop as claimed in claim 2, wherein the visual tension indicator is a chain having one end connected to the bearing plate and the other end connected to the first hollow conduit or the clamp assembly.

4. The prop as claimed in claim 1, wherein the clamp assembly is a first clamp assembly and the jack assembly further comprises:

a jack body having a first jack end, a second jack end and defining a fluid inlet opening;

a piston having a plunger and a piston arm, the plunger connected to one end of the piston arm and the plunger housed in the jack body and acting on the first clamp assembly;

the base defining a first partial orifice positioned at the other end of the piston arm, opposite the plunger; and a guide defining a second partial orifice positioned adjacent to the first jack end of the jack body.

5. A yieldable prop having a first end and an opposite second end, the yieldable prop comprising;

a first hollow conduit having a first end and an opposite second end, with the first end of the first conduit providing the first end of the prop;

a second conduit having a first end and an opposite second end, with the second end of the second conduit providing the second end of the prop, the first end of the second conduit slidably mounted in the first conduit through the second end of the first conduit; and a restraint arrangement comprising:

a clamp assembly detachably secured to outer surface of the second conduit to prevent movement of the clamp assembly and the second conduit relative to one another and extending above the outer surface of the second conduit to limit movement of the second conduit into the first conduit, wherein the clamp assembly comprises a side facing and spaced from the first end of the second conduit and the restraint arrangement prevents movement of a portion of the second conduit between the side of the clamp assembly and the first end of the second conduit into and out of the first conduit, wherein the clamp assembly comprises:

a first split conduit defining an inner major surface and an opposite outer major surface;

a second split conduit defining an inner major surface and an opposite outer major surface, with the inner surface of the first and second split conduits engaging the outer surface of the second conduit;

at least one bolt having a U-shaped portion and two threaded legs with a U-shaped portion of the at least one bolt engaging portion of the outer surface of at least one of the split conduits;

a brace defining a first orifice to receive one of the threaded legs of the at least one bolt and a second orifice to receive the other one of the threaded legs of the at least one threaded leg;

a threaded nut on each of the threaded legs of the at least one bolt to bias the brace and the at least one bolt against the outer surface of the first and second split conduits to bias the inner surface of the first and second split conduits against the outer surface of the second conduit; and friction members along the inner major surface of the first and second split conduits.

6. The prop as claimed in claim 5, further comprising a bearing plate positioned at least on one of the ends of the yieldable prop.

7. The prop as claimed in claim 6, wherein the bearing plate is selected from a shape comprising planar, volcano, C-shaped, and I-shaped.

8. The prop as claimed in claim 5, further comprising a visual tension indicator.

* * * * *